US008522650B2

(12) United States Patent
Tatsuno

(10) Patent No.: US 8,522,650 B2
(45) Date of Patent: Sep. 3, 2013

(54) ANGLE NUT RUNNER

(75) Inventor: Koji Tatsuno, Osaka (JP)

(73) Assignee: Uryu Seisaku Ltd., Osaka (JP)

( * ) Notice: Subject to any disclaimer, the term of this patent is extended or adjusted under 35 U.S.C. 154(b) by 1577 days.

(21) Appl. No.: 11/658,673

(22) PCT Filed: Aug. 11, 2005

(86) PCT No.: PCT/JP2005/014754
§ 371 (c)(1),
(2), (4) Date: Jan. 29, 2007

(87) PCT Pub. No.: WO2006/019036
PCT Pub. Date: Feb. 23, 2006

(65) Prior Publication Data

US 2008/0314207 A1 Dec. 25, 2008

(30) Foreign Application Priority Data

Aug. 18, 2004 (JP) ..... 2004-238082

(51) Int. Cl.
*B25B 23/14* (2006.01)

(52) U.S. Cl.
USPC ..... 81/57.13; 81/57.29; 81/467; 81/57

(58) Field of Classification Search
USPC ..... 81/57.13, 57.29
See application file for complete search history.

(56) References Cited

U.S. PATENT DOCUMENTS 4,318,314 A * 3/1982 Furedi et al. ..... 81/57.29
5,115,701 A * 5/1992 Lehnert ..... 81/57.13
5,172,774 A * 12/1992 Melrose ..... 173/182
5,404,775 A * 4/1995 Abe ..... 81/469

FOREIGN PATENT DOCUMENTS

JP 61-76282 4/1986
JP 2-31671 2/1990

OTHER PUBLICATIONS

International Search Report issued Nov. 15, 2005 in the International (PCT) Application PCT/JP2005/014754 of which the present application is the U.S. National Stage.

* cited by examiner

*Primary Examiner* — Monica Carter
*Assistant Examiner* — Melanie Alexander
(74) *Attorney, Agent, or Firm* — Wenderoth, Lind & Ponack, L.L.P.

(57) ABSTRACT

An angle nut runner capable of accurately measuring a genuine tightening force includes an output shaft pivotally supported approximately perpendicular to the rotating shaft 1 of the drive source, a strain measuring mechanism for measuring a strain generated in the output shaft is disposed on the output shaft.

2 Claims, 3 Drawing Sheets

ANGLE NUT RUNNER

TECHNICAL FIELD

The present invention relates to a nut runner for performing tightening work and loosening work of bolts & nuts and screws, more specifically an angle nut runner having an output shaft pivotally supported approximately perpendicular to the rotating shaft of the drive source.

BACKGROUND ART

Conventionally, nut runners are widely used as a tool for performing tightening work and loosening work of bolts & nuts and screws.

Nut runners are roughly classified as straight nut runners having an output shaft pivotally supported on a straight line against the rotating shaft of the drive source, and angle nut runners having an output shaft pivotally supported approximately perpendicular to the rotating shaft 1 of the drive source M. Angled nut runners are applied to tightening work and loosening work at comparatively narrow points where a straight nut runner cannot be used, as shown in FIG. 3.

As greater importance is attached to quality control of industrial products, in recent years, a production control system has been adopted which consists of automatically measuring-recording the number of tightened pieces and tightening force of bolts & nuts and screws, and feedback the results of measurement in real time to the production of industrial products.

In the angle nut runner indicated in FIG. 3, a torque transducer TM for performing measurement of tightening force is disposed at about the middle position of the nut runner body B, to be available for use for the above-described production control system.

However, in the case where the torque transducer TM for performing measurement of tightening force is disposed at about the middle position of the nut runner body B, there is a problem that the genuine tightening force cannot be measured accurately, because the tightening force measured by the torque transducer TM inevitably includes the resistance, etc. of the power transmission mechanism for transmitting the turning force of the drive source M to the output shaft 2, to be concrete, the bevel gear mechanism BG.

SUMMARY OF THE INVENTION

The objective of the present invention is to provide, in view of the problem of the above-described conventional angle nut runner, an angle nut runner capable of accurately measuring the genuine tightening force.

To achieve the above-mentioned objective, the angle nut runner according to the present invention is an angle nut runner having an output shaft pivotally supported approximately perpendicular to the rotating shaft of the drive source, characterized in that a strain measuring mechanism for measuring a strain generated in the output shaft is disposed on the output shaft.

A spur gear may be disposed on the output shaft, as a power transmission mechanism for transmitting the turning force of the drive source to the output shaft.

According to the angle nut runner of the present invention, which is an angle nut runner having an output shaft pivotally supported approximately perpendicular to the rotating shaft of the drive source, wherein a strain measuring mechanism for measuring a strain generated in the output shaft is disposed on said output shaft, it is possible to accurately measure the genuine tightening force, and which does not include any resistance, etc. of the power transmission mechanism for transmitting the turning force of the drive source to the output shaft.

Moreover, by disposing a spur gear on the output shaft, as a power transmission mechanism for transmitting the turning force of the drive source to the output shaft, it is possible to realize the portion near the output shaft of the angle nut runner in a compact shape, and dispose the strain measuring mechanism for measuring a strain generated in the output shaft without increasing the shape of the portion near the output shaft.

DETAILED DESCRIPTION OF THE INVENTION

An embodiment of the angle nut runner according to the present invention will be explained below, with reference to drawings.

Embodiment 1

Figure 1:
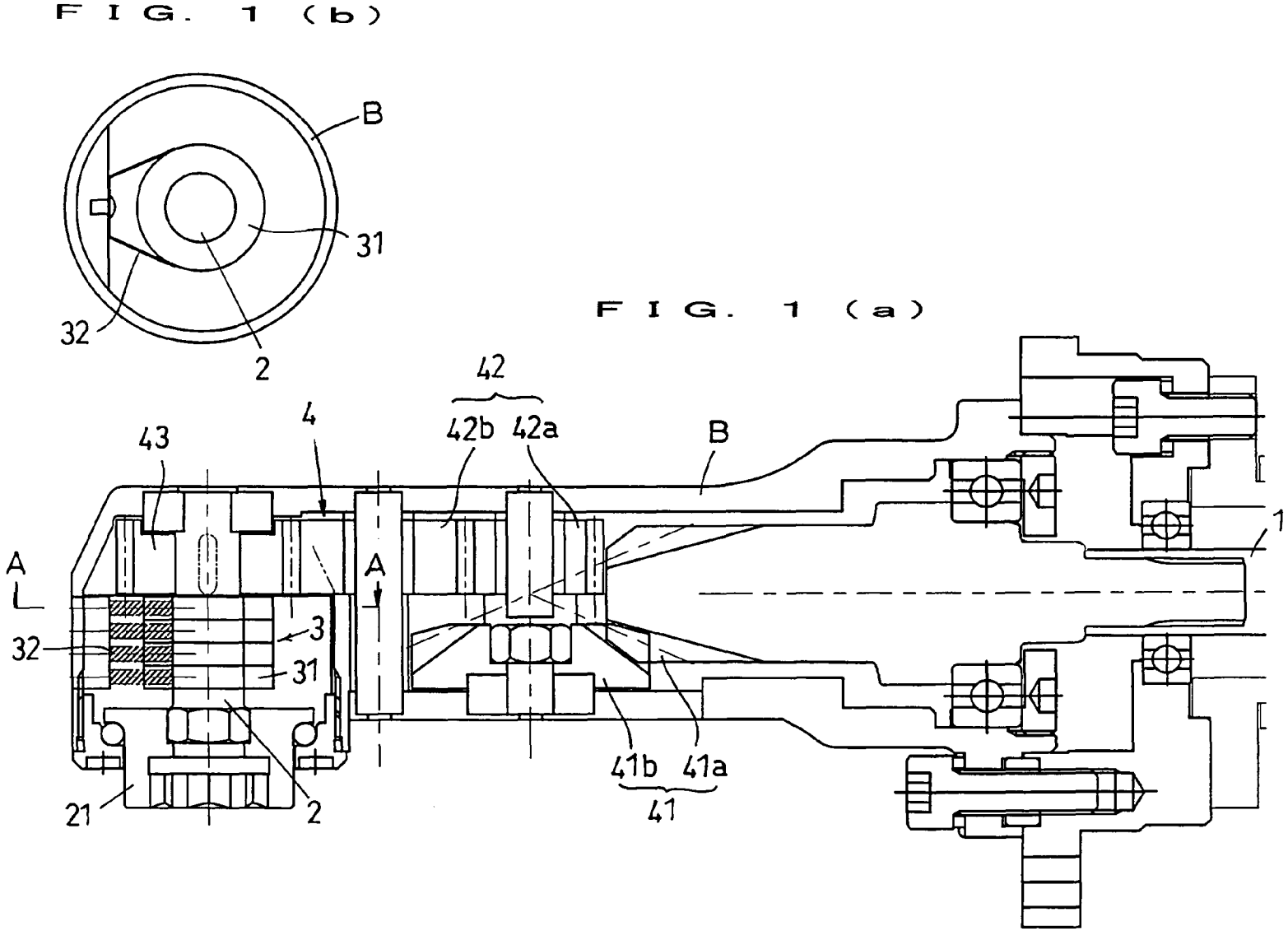
FIG. 1 indicates an embodiment of the angle nut runner according to the present invention, (a) being a front sectional view, and (b) a sectional view A-A of (a).

FIG. 1 illustrates an embodiment of the angle nut runner according to the present invention.

This angle nut runner is an angle nut runner having an output shaft 2 pivotally supported approximately perpendicular to the rotating shaft 1 of the drive source, such as electric motor, air motor, etc. (not illustrated), wherein a strain measuring mechanism 3 for measuring a strain generated in the output shaft 2 is disposed on the output shaft 2.

In this embodiment, a bevel gear mechanism 41 composed of bevel gears 41*a*, 41*b* is disposed, in the nut runner body B, as power transmission mechanism 4 for transmitting the turning force of the drive source to the output shaft 2, so as to convert the turning force of the drive source into a turning force centering around the rotating shaft 1 of the bevel gears 41*b* parallel to the output shaft 2, and further transmit this turning force, through a spur gear mechanism 42 composed of spur gears 42*a*, 42*b* disposed in the nut runner body B, to a spur gear 43 disposed on the output shaft 2, to rotatively drive the output shaft 2.

As described above, by disposing a spur gear 43 on the output shaft 2, as power transmission mechanism 4 for transmitting the turning force of the drive source to the output shaft 2, it becomes possible to realize the portion near the output shaft 2 of the angle nut runner in compact shape, and dispose the strain measuring mechanism 3 for measuring a strain generated in the output shaft 2 without increasing the shape of the portion near the output shaft 2 which is often inserted in a narrow place.

The strain measuring mechanism 3 for measuring a strain generated in the output shaft 2 is disposed on the output shaft 2 on the tip side from the spur gear 43 as power transmission mechanism 4 disposed on the output shaft 2.

This strain measuring mechanism 3, not particularly restricted in the system if it can only measure the strain generated in the output shaft 2, is so designed, in this embodiment, that the output of the strain gauge (not illustrated) pasted on the output shaft 2 is taken out through a snap ring 31 disposed on the output shaft 2 side and a brush 32 disposed on the nut runner body B side.

Figure 2:
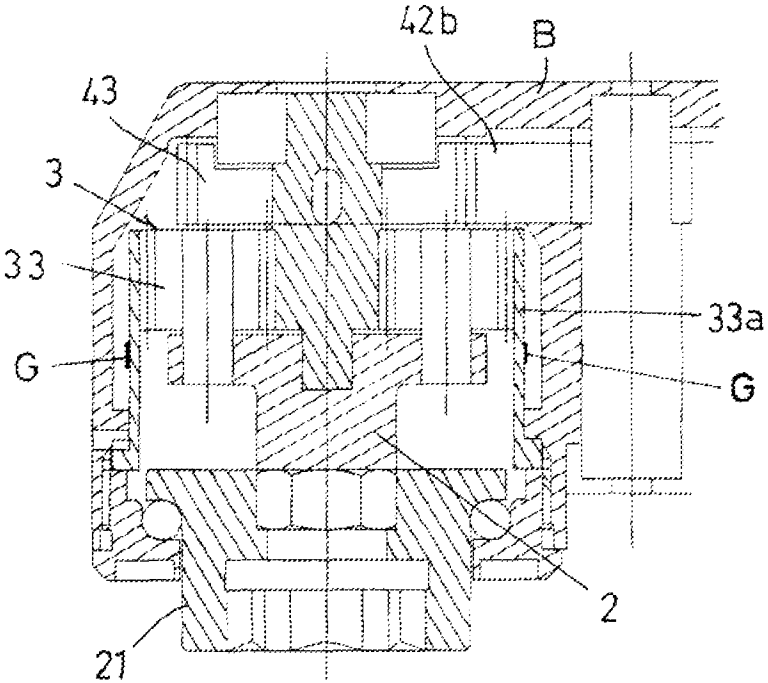
FIG. 2 indicates a modified embodiment of the angle nut runner according to the present invention, (a) being a front sectional view of main part, and (b) a front sectional view of the attachment.
Figure 2:
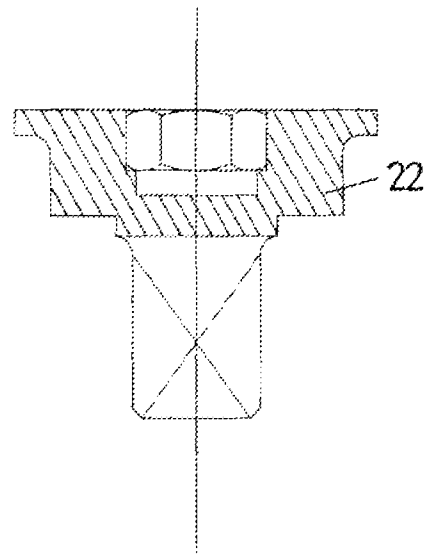
Figure 3:
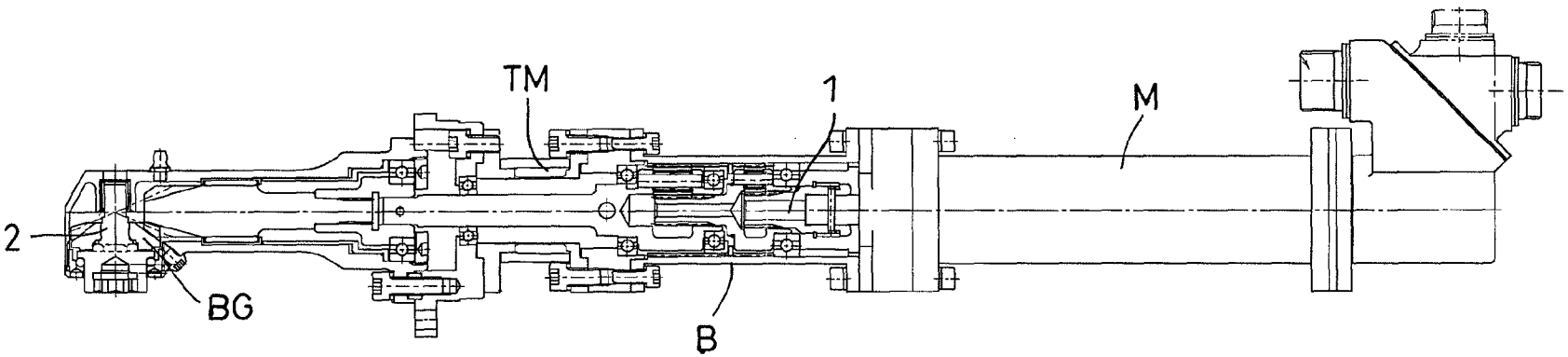
PRIOR ART FIG. 3
FIG. 3 is a front sectional view showing a conventional angle nut runner.

For the strain measuring mechanism 3, in addition to the above-described system of directly pasting a strain gauge on the output shaft 2, other optional systems may also be adopted, such as a system of disposing the internal gear 33 engaged with the output shaft 2, and pasting a strain gauge G on the outer cylinder 33*a* of an internal gear 33 fixed on the nut runner body B side, as the modified embodiment indicated in FIG. 2, and a magnetic strain system of forming a magnetic strain portion on the outer circumferential face of the output shaft 2, and fixing a magnetizing-detecting coil on the nut runner body B side on the outer circumferential face of this magnetic strain portion, etc.

Furthermore, although the output shaft 2 can be formed in a shape that enables direct operation of bolts & nuts and screws, attachments 21, 22 constructed with separate bodies are mounted on the output shaft 2, as shown in FIG. 1 and FIG. 2, in this embodiment.

such a structure enables the ability cope with a variety of bolts & nuts and screws, and facilitate execution of the maintenance work.

So far, the angle nut runner according to the present invention has been explained based on its embodiment, but the present invention is not restricted to the construction described in the embodiment given above, and may be changed in construction as required within a range not deviating from its purpose.

As explained above, the angle nut runner according to the present invention, which can measure the genuine tightening force be accurately, can be used suitably for applications requiring accurate measurement of tightening force, such as a manufacturing plant adopting a production control system which consists in automatically measuring-recording the number of tightened pieces and tightening force of bolts & nuts and screws, and feeding back the results of measurement in real time to the production of industrial products, etc.

The invention claimed is:

1. An angle nut runner comprising:

a body with a side;

an output shaft rotatably supported approximately perpendicular to a rotating shaft of a drive source;

an internal gear having an outer cylinder, the internal gear being fixed on the side of the body and engaging the output shaft; and a strain measuring mechanism for measuring a strain generated in the output shaft pasted on the outer cylinder of the internal gear.

2. An angle nut runner as defined in claim 1, further comprising a spur gear disposed on the output shaft as a power transmission mechanism for transmitting a turning force of the drive source to the output shaft.

* * * * *